US008568254B2

(12) United States Patent
Keller

(10) Patent No.: US 8,568,254 B2
(45) Date of Patent: Oct. 29, 2013

(54) BATTING TEE SYSTEM FOR BAT-AND-BALL GAMES

(76) Inventor: Steve Keller, Seattle, WA (US)

( * ) Notice: Subject to any disclaimer, the term of this patent is extended or adjusted under 35 U.S.C. 154(b) by 0 days.

(21) Appl. No.: 12/634,546

(22) Filed: Dec. 9, 2009

(65) Prior Publication Data

US 2011/0136592 A1 Jun. 9, 2011

(51) Int. Cl.
*A63B 71/00* (2006.01)
*A63B 69/00* (2006.01)

(52) U.S. Cl.
USPC ..... 473/417; 473/454; 473/422

(58) Field of Classification Search
USPC ..... 473/422, 417, 421, 431, 451, 454–456; D21/713, 780
See application file for complete search history.

(56) References Cited

U.S. PATENT DOCUMENTS

| | | | | | |
|---|---|---|---|---|---|
| 3,139,282 | A * | 6/1964 | Lande | 473/417 |
| 3,489,411 | A | 1/1970 | Morelli | |
| 4,563,005 | A * | 1/1986 | Hand et al. | 473/455 |
| 4,664,374 | A * | 5/1987 | Groves | 473/417 |
| 4,709,924 | A * | 12/1987 | Wilson et al. | 473/417 |
| 4,872,674 | A * | 10/1989 | Deal | 473/435 |
| 4,886,267 | A | 12/1989 | Licciardi | |
| 4,991,838 | A * | 2/1991 | Groves | 473/451 |
| 5,004,234 | A * | 4/1991 | Hollis | 473/417 |
| 5,351,948 | A * | 10/1994 | Thomas | 473/417 |
| 5,388,823 | A * | 2/1995 | Prieto | 473/417 |
| 5,452,896 | A | 9/1995 | Core | |
| 5,516,115 | A * | 5/1996 | McLain | 473/417 |
| 5,556,091 | A | 9/1996 | Lin | |
| 6,612,942 | B1 * | 9/2003 | Battersby et al. | 473/451 |
| 6,979,273 | B2 * | 12/2005 | Tsai | 473/417 |
| 7,063,632 | B2 * | 6/2006 | Green | 473/417 |
| 7,479,074 | B1 * | 1/2009 | Pierce | 473/417 |
| 7,641,573 | B2 * | 1/2010 | Cech | 473/417 |
| D638,079 | S * | 5/2011 | Cheng | D21/717 |
| 2002/0123397 | A1 * | 9/2002 | Brasuell | 473/421 |
| 2005/0255945 | A1 | 11/2005 | Green | |
| 2009/0093325 | A1 * | 4/2009 | Meltzer et al. | 473/454 |

* cited by examiner

*Primary Examiner* — Mitra Aryanpour
(74) *Attorney, Agent, or Firm* — Richard C. Vershave; Foster Pepper, PLLC

(57) ABSTRACT

A batting tee system includes a batting tee assembly that may be used with conventional balls or with the ball described as an embodiment of the present invention. Optionally, the batting tee assembly may be used with a netting system that provides feedback to a batter based on a trajectory of the ball after it has been struck by a bat and leaves the batting tee assembly. In one embodiment, the batting tee assembly includes a support base coupled to a swing arm, which in turn is coupled to an adjustable-height batting tee. The batting tee system may be configured for both left and right handed batters and also placed in a portable or storable configuration.

20 Claims, 7 Drawing Sheets

BATTING TEE SYSTEM FOR BAT-AND-BALL GAMES

FIELD OF THE INVENTION

This invention relates generally to a batting tee system, and specifically relates to a batting tee system to help improve batting stances and hitting mechanics of ball players.

BACKGROUND OF THE INVENTION

"Going with a pitch," a phrase used often in baseball, means knowing where to strike the ball depending on the location of the pitch as it crosses the plate. Advanced players work on this concept regularly, but conventional wisdom considers the concept too complicated for teaching to intermediate or younger players. Generally, intermediate and younger players are taught a proper batting stance and hitting mechanics through repetition using a conventional batting tee, soft toss pitching, full speed pitching (e.g., by a pitcher or pitching machine), or some combination thereof.

SUMMARY OF THE INVENTION

The present invention relates to a batting tee system and methods of using and assembling the same. The batting tee system includes a batting tee assembly that may be used with conventional balls or with the ball described herein. Optionally, the batting tee assembly may be used with a netting system that provides feedback to a batter based on a trajectory of the ball after it has been struck by a bat and leaves the batting tee assembly. In one embodiment, the batting tee assembly includes a support base coupled to a swing arm, which in turn is coupled to an adjustable-height batting tee. The batting tee system may be configured for both left and right handed batters and also placed in a portable or storable configuration.

In accordance with an aspect of the invention, a batting tee system includes a ball carrying at least one target indicator alignable relative to a home base; a batting tee assembly having a base coupled to the home base, the base adjustably coupled to a swing arm that extends laterally over and proximate to an upper surface of the base, the swing arm coupled to an adjustable-height tee selectively positionable along a desired bat-to-ball contact path defined relative to the home base; and a netting system positionable at a desired distance from the batting tee assembly, the netting system having a plurality of indicators arranged to provide feedback information regarding a direction of the ball after it is struck with the bat.

In accordance with another aspect of the invention, a batting tee assembly includes a base portion configured with a home base; a swing arm adjustably coupled to the base, the swing arm extending laterally over and proximate to an upper surface of the base, the swing arm selectively positionable along an arc relative to the home base; and an adjustable-height batting tee coupled to the swing arm, the tee movable with the swing arm to be positioned in a location along the arc corresponding to a type of pitch being simulated.

In accordance with yet another aspect of the invention, a netting system for halting a ball includes a frame assembly; a netting material coupled to the frame assembly; and a plurality of indicators arranged to provide feedback information regarding a direction of the ball after it is struck with a bat.

In accordance with another aspect of the invention, a method of setting up a batting tee system includes the steps of (1) arranging a home base for a left or right handed batter, the home base coupled to a base portion of the batting tee system; (2) coupling a first end portion of a swing arm to the base portion; (3) rotating a second end portion of the swing arm about a pivot located relative to the home base, the second end portion distally located from the first end portion; and (4) setting an adjustable-height batting tee at a desired position along a contact path to simulate a desired pitch.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
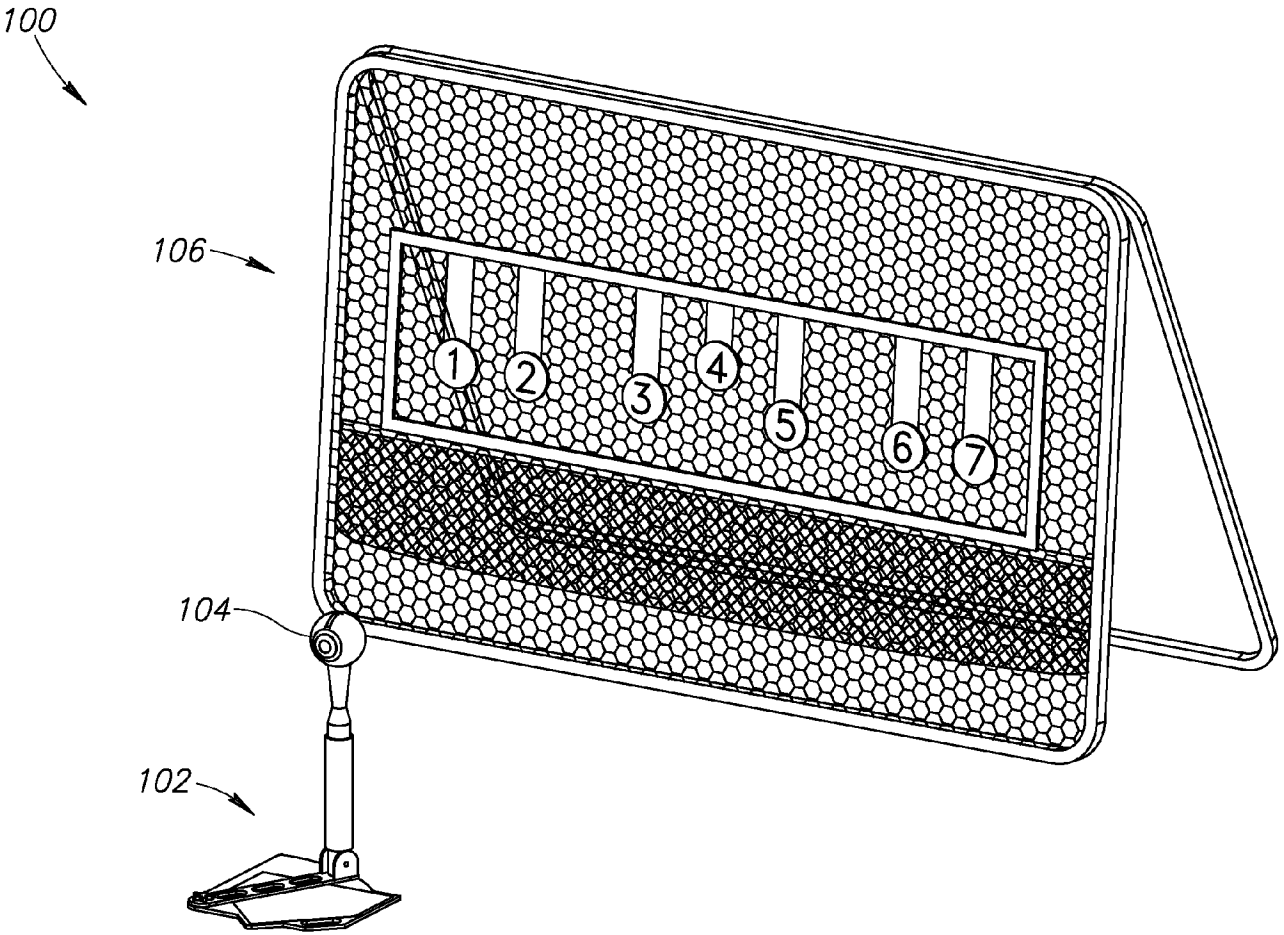
FIG. 1 is a batting tee system having a batting tee assembly, a ball and a netting system according to an embodiment of the present invention.

In the following description, certain specific details are set forth in order to provide a thorough understanding of various embodiments of the invention. However, one skilled in the art will understand that the invention may be practiced without these details. In other instances, well-known structures associated with bat and ball systems, hitting systems, catching systems and the assembly and operation thereof have not necessarily been shown or described in detail to avoid unnecessarily obscuring descriptions of the embodiments of the invention. At least one embodiment of the invention includes a batting tee system that allows and encourages players to work on proper bat-to-ball contact for a variety of pitches.

Unless the context requires otherwise, throughout the specification and claims which follow, the word "comprise"

and variations thereof, such as, "comprises" and "comprising" are to be construed in an open, inclusive sense that is as "including, but not limited to."

In addition, throughout the specification and claims which follow, any reference to a bat-and-ball game may include, but is not limited to, games such as baseball, softball, stickball, rounders, pesäpallo, Finnish baseball, and British baseball. Bat-and-ball games are generally played when one team (the fielding team) has possession of the ball and delivers it to a member of the other team (the batting team), who tries to hit it. The two opposing teams take turns playing these two distinct roles, which are continuous during a specified interval, commonly referred to as an inning For purposes of the present description, the word "ball" should be broadly interpreted to relate to any ball used in a bat-and-ball activity. Some examples of such balls include, but are not limited to, regulation and non-regulation baseballs and softballs, cricket balls, tennis balls, etc. Similarly, the term "bat" may be interpreted to broadly include, but not be limited to, regulation and non-regulation baseball bats, softball bats, wooden bats, metal bats, cricket bats, etc. Lastly, the phrase "home base" should be interpreted as any plate, symbolic reference, design, or other device used to provide a visual reference for a batter. The term "home base" may be use synonymously with the term "home plate" herein.

For purposes of the present description to maintain brevity and consistency, the various embodiments of the invention will be described relative to the bat-and-ball game of baseball. Baseball players may learn by a fairly young age that the proper place to make contact with a baseball depends on where it crosses home plate. Many batting instructors teach that an inside pitch should be met by the bat well in front of home plate while contact with an outside pitch should be further back relative to the plate. Advanced hitters, those who have played baseball for many years, are taught how and where to make proper contact as the ball crosses home plate through such activities as live batting practice or soft toss. Because players of all ages are encouraged to practice their swing using a batting tee, the batting tee system described herein permits this type of general batting practice while providing numerous advantages for simulating different types of pitches (e.g., high and inside, low and outside, etc.) and where contact should be made when the ball crosses home plate.

Figure 2:
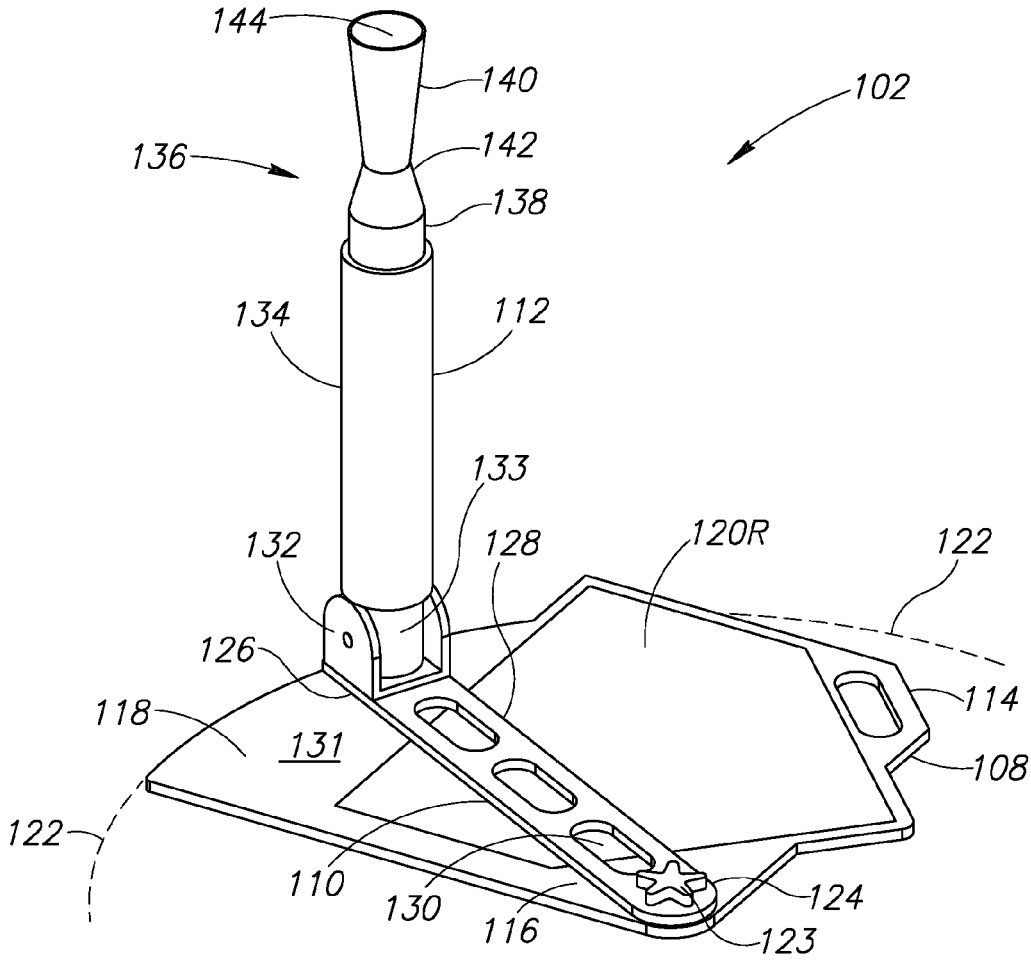
FIG. 2 is perspective view of the batting tee assembly of FIG. 1 with a batting tee in an operable position.

FIG. 1 shows a batting tee system 100 having a batting assembly 102 and a ball 104, which may take the form of a marked ball described with reference to FIG. 9. The batting tee system 100 may optionally include a netting system 106 for stopping the ball 104 after contact by a bat (not shown). The batting tee system 100 may be made or adjusted to various sizes and may be used indoors or outdoors. The batting tee system 100 permits the ball to be set at a desired contact point relative to the home plate 120R (FIG. 2). In turn, this builds strong home plate reference awareness and hitting mechanics for beginning to advanced batters. The batting tee assembly 102 is easily adjustable and keeps the ball 104 in a level position, which in turn permits batters to work on a variety of ball contact points, such as inside, outside, high and low.

Components of the batting tee system 100 may be made from plastic, metal, rubber or reinforced composites. Further, the batting tee system 100 is portable and storable because it includes features that permit it to be folded into a compact or portable configuration. The batting tee assembly 102 is also convertible for use by both left-handed and right-handed batters, which will be explained in greater detail below.

FIG. 2 shows the batting tee assembly 102 in an upright or operational configuration and also in a right-handed batting configuration. The batting tee assembly 102 includes a support base 108 coupled to a swing arm 110, which in turn is coupled to a batting tee 112. The support base 108 may be configured to substantially prevent tipping or undesired rocking of the batting assembly 102 when in use, for example when the bat strikes the batting tee 112. In the illustrated embodiment, the support base 108 includes a handle 114, a swing arm attachment region 116, a contact path region 118 and a home base region 120R, where the "R" refers to the support base 108 being in the right-handed batting configuration. In one embodiment, the support base 108 is made from a durable rubber material, such as a natural rubber material, and selectively weighted to prevent tipping or rocking The home base region 120, as illustrated, takes the familiar form of a home plate in baseball, but may take other shapes as well. The home base region 120 may take the form of an insert bonded into a recessed portion of the support base 108, may take the form of an adhesive-backed, home-plate-shaped sticker bonded onto the support base 108, or may be painted or otherwise printed onto the support base 108.

In the illustrated embodiment, the contact path region 118 includes a periphery that defines a contact path 122, which in turn is defined by a sweeping or rotational motion of the swing arm 110 about a pivot point 123, which is located on the swing arm attachment region 116.

Figure 11:
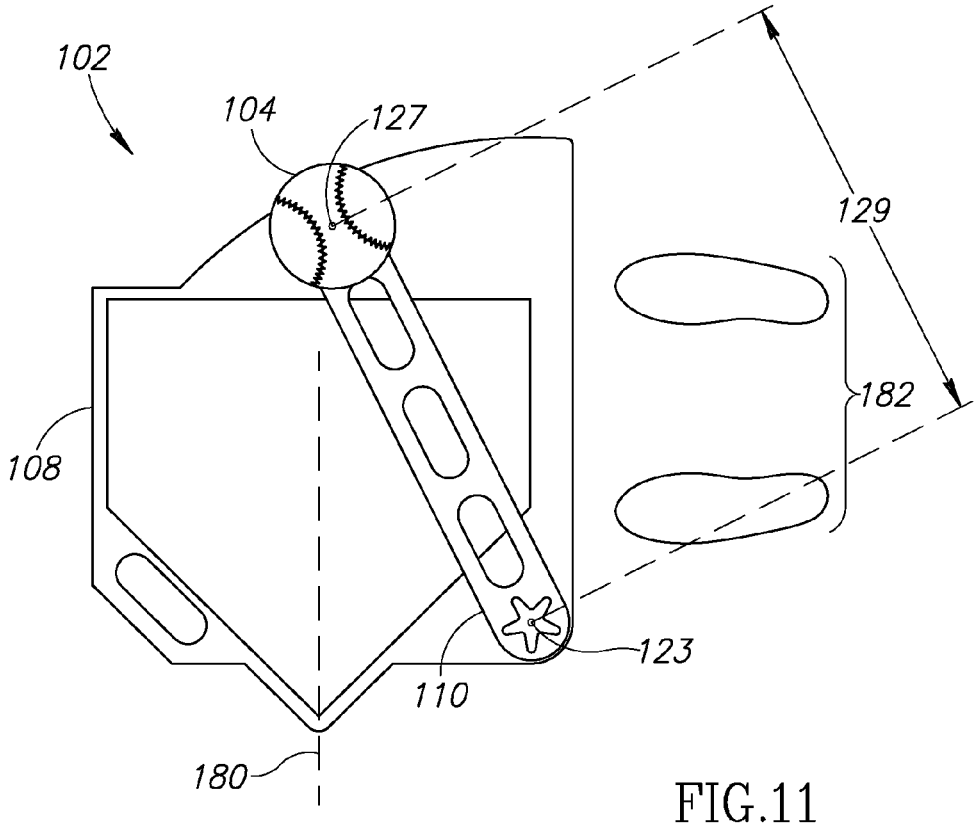
FIG. 11 is a top plan view of the batting tee assembly and ball of FIG. 1 showing an exemplary setting thereof for one type of simulated pitch.

The swing arm 110 includes a first end portion 124 rotational coupled to the support base 108 through the pivot point 123. The swing arm 110 further includes a second end portion 126 distally located from the first end portion 124 with a body 128 extending therebetween. The body 128 may include holes or openings 130 to reduce the overall weight of the swing arm 110. The swing arm 110 extends laterally over and proximate to an upper surface 131 of the support base 108. As best shown in FIG. 11, an effective length 129 of the swing arm 110, which is measured from the pivot point 123 to a cylindrical axis point 127 of the batting tee 112, defines the contact path 122. The operation of the swing arm 110 along the contact path 122 in conjunction with the positioning of the batting tee 112 relative to the home base 120 is discussed in greater detail below.

Still referring to FIG. 2, an attachment member 132 for coupling the swing arm 110 to the batting tee 112 may take the form of a boss, a lug or some other structural member. The attachment member 132 may be integrally formed with the swing arm 110 or a separate component. An extender 133 configured to receive the batting tee 112 may be connected to the attachment member 132. These connections are described in greater detail below with respect to FIG. 5.

In the illustrated embodiment, the batting tee 112 takes the form of a telescoping batting tee having a lower segment 134 that telescopically and slidably receives an upper segment 136. The upper segment 138 includes a lower portion 138 configured to slide into the lower segment 134, an upper portion 140 configured to support the ball, a necked down portion to provide flexibility when the upper portion 140 is struck with a bat (not shown), and a cup or funnel shaped portion 144 configured to receive and support the ball. The batting tee 112 may be made from a durable rubber material, such as a natural rubber material and its thickness may be sufficient to withstand repeated impact strikes from the bat (not shown).

Figure 3:
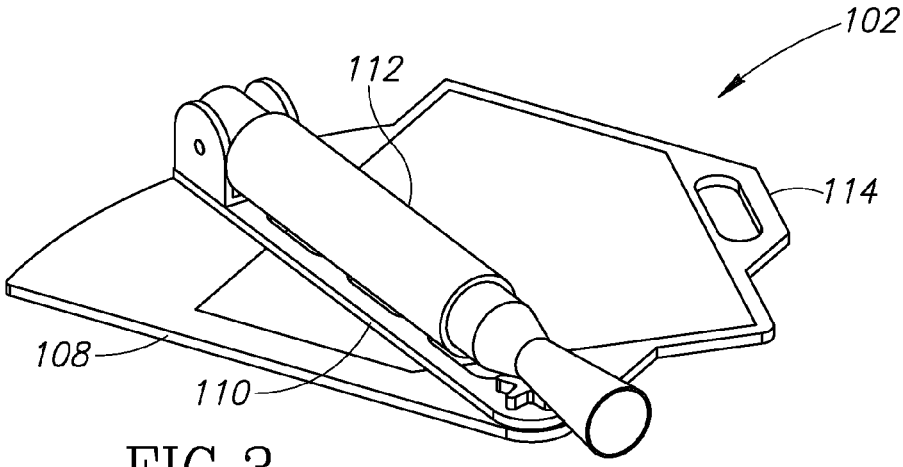
FIG. 3 is perspective view of the batting tee assembly of FIG. 1 with a batting tee in a stored or portable position.

FIG. 3 shows the batting tee assembly 102 in a stored or portable configuration. The batting tee 112 is folded down onto the swing arm 110 and these components may be located at any desired orientation relative to the support base 108. The handle 114 may be used to carry or otherwise move the batting tee assembly 102.

Figure 4:
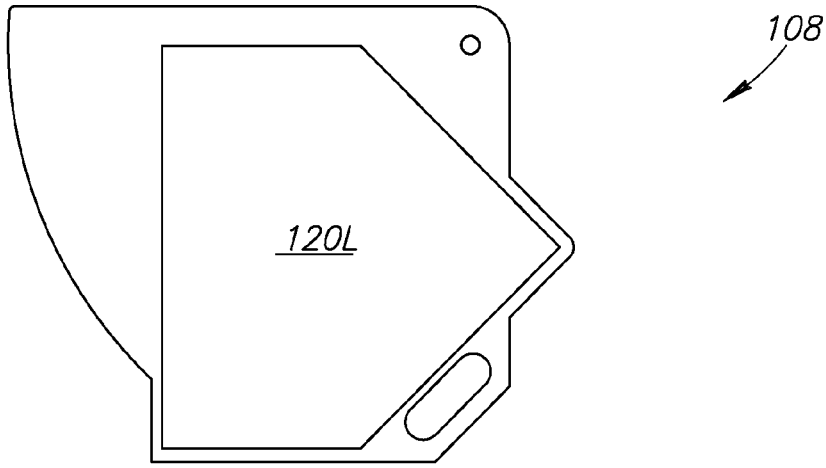
FIG. 4 is bottom plan view of a support base for the batting tee assembly of FIG. 1 with a home base configured for a left-handed batter.

FIG. 4 shows the support base 108 in a left-handed batting configuration, which may be achieved by simply flipping the support base 108 over. In other words, the home base 120L is provided on mirror surfaces (i.e., top and bottom surfaces) of the support base 108. The "L" refers to the support base 108 being in the left-handed batting configuration.

Figure 5:
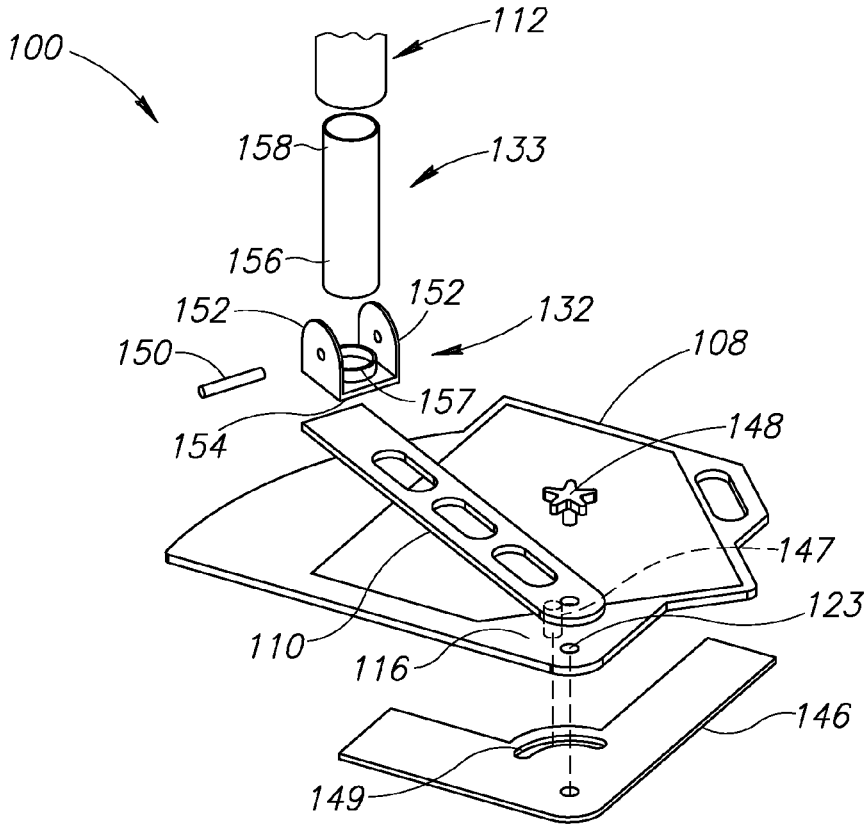
FIG. 5 is an exploded, perspective view of a batting tee assembly according to an embodiment of the present invention.

FIG. 5 shows an exploded view of the batting tee system 100 having the support base 108, the swing arm 110 and the batting tee 112. The support base 108 may include one or more reinforcement members 146, which may be configured with a desired shape, thickness and structural properties. In the illustrated embodiment, the reinforcement member 146 takes the form of a corner reinforcement member 146 that may be coupled to the swing arm attachment region 116. If the support base 108 is switched from a right-handed to a left-handed batting configuration, or vice versa, the reinforcement member 146 may be switched as well. In one embodiment, the reinforcement member 146 may be imbedded or over-molded into the support base 108 such that it remains permanently in place and may not be visible when looking downward at the base 108. A fastening device 148 may be used to attach the swing arm 110, the support base 108 and the corner reinforcement 146 together. In the hole forming the pivot point 123, it is appreciated that a sleeve or liner (not shown) may be inserted to provide bearing protection for the support base 108. In addition, the sleeve or liner may include internal threads for engaging the fastener 148. In one embodiment, a range-of-motion limiter 147 may extend from the swing arm 110 and be received by a slot 149 formed in the reinforcement member 146. Accordingly, the slot 149 may have a configuration, such as a desired curvature to limit or otherwise prevent the swing arm 110 from rotating beyond a desired amount relative to the support base 108.

The batting tee 112 may be pin-connected with the swing arm 110 by way of the attachment member 132, the extender 133 and a pin 150. The attachment member 132 may take the form of a fitting having ears 152 coupled to a base member 154, which in turn may be mechanically attached (e.g., bonded, fastened, welded, etc.) to the swing arm 110. The extender 133, likewise, may take the form of cylindrical member having a first end portion 156 distally located from a second end portion 158. The first end portion 156 is sized to frictionally engage or threadably couple with a complementary-shaped boss 157 extending from the base member 154 while the second end portion 158 is sized to be telescopically received by the batting tee 112. The fit between the aforementioned components may be sufficiently snug to frictionally prevent undesired rotation. The pin 150 operates to provide the pin-connection, thus permitting the batting tee 112 to be moved between the operational and portable configurations. When the batting tee system 100 is in the operational configuration, the pin 150 may be retained or otherwise held in place by conventional means, such as with a cotter pin (not shown).

Figure 6:
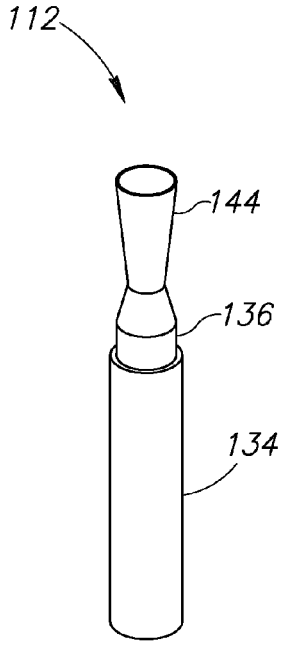
FIG. 6 is a side elevational view of a batting tee adjusted to a minimum height according to an embodiment of the present invention.

FIGS. 6-9 show how the batting tee 112 may be adjusted to different heights. In FIG. 6, the batting tee 112 is shown at its minimum height. To achieve the minimum height, the upper segment 136 is telescopically moved into the lower segment 134 until a minimum height of the batting tee 112 is about twenty inches as measured from the support base 108 (FIG. 2) to an upper edge of the cup-shaped portion 144.

Figure 7:
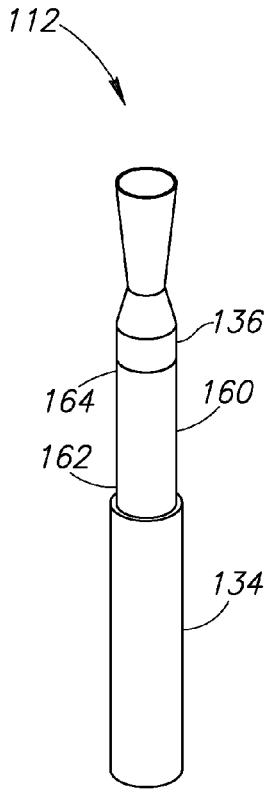
FIG. 7 is a side elevational view of a batting tee adjusted to a mid-range height according to an embodiment of the present invention.

In FIG. 7, the batting tee 112 is shown at a mid-range height that may be achieved by using an intermediate member 160 having a lower portion 162 configured to be received by the lower segment 134 and an upper portion 164 configured to receive the upper segment 136.

Figure 8:
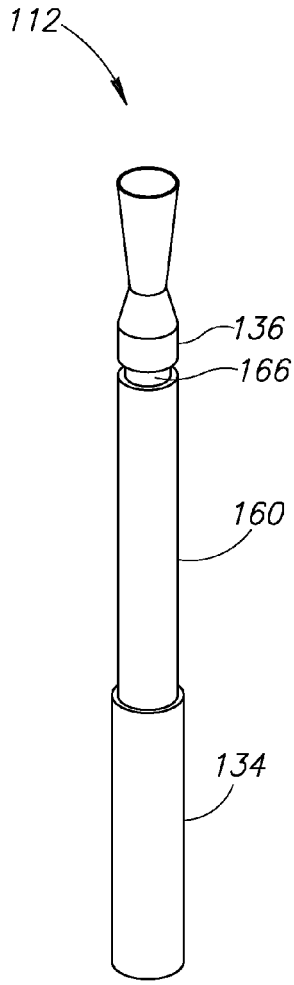
FIG. 8 is a side elevational view of a batting tee adjusted to a maximum height according to an embodiment of the present invention.

FIG. 8 shows the batting tee 112 at a maximum height by having the intermediate member 160 fully, telescopically extended and also having the upper segment 136 fully, telescopically extended. In the illustrated embodiment, the upper segment 136 includes a coupling portion 166 that is received by the intermediate member 160. When the batting tee 112 includes the intermediate member 160, the height of the batting tee 112 may be adjusted between about thirty inches to over fifty inches according to an embodiment of the invention. If the intermediate member 160 is not included, the height of the batting tee may be adjusted between about twenty inches to over thirty inches. In one embodiment, the batting tee 112 may not include an intermediate member, but still be adjustable to have a height over fifty inches. Nevertheless, it is appreciated that these defined adjustment heights are merely provided as examples and are not meant to limit the scope of the invention.

Figure 9:
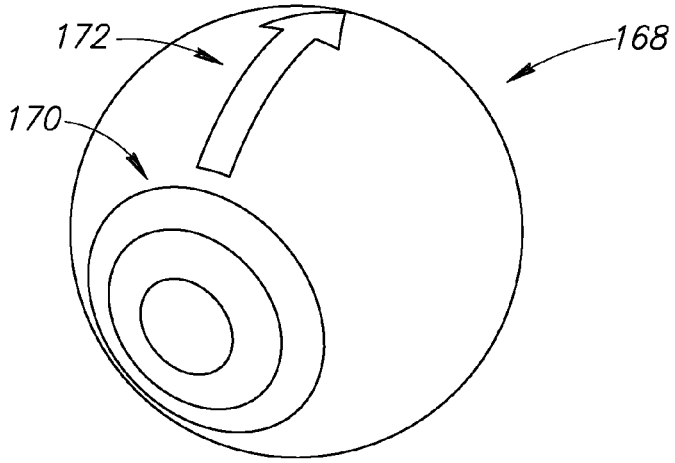
FIG. 9 is a perspective view of the ball used in the batting tee system of FIG. 1 according to an embodiment of the present invention.

FIG. 9 shows a ball 168 having a target indicia or marking 170 and a directional indicia or marking 172. The target indicia 170 may take the form of a bulls-eye marking to indicate where the batter should make contact with the bat when swinging. The directional indicia 172 may take the form of an arrow aligned with the target indicia 170. The direction of the arrow indicates to the batter the general direction the ball should travel after being struck with the bat. The ball 168 may be made from a medium-density foam, rubber or other material that would provide sufficient weight and robustness while not allowing it to hurt property or persons if hit in an undesired direction or in an undesired manner.

Figure 10:
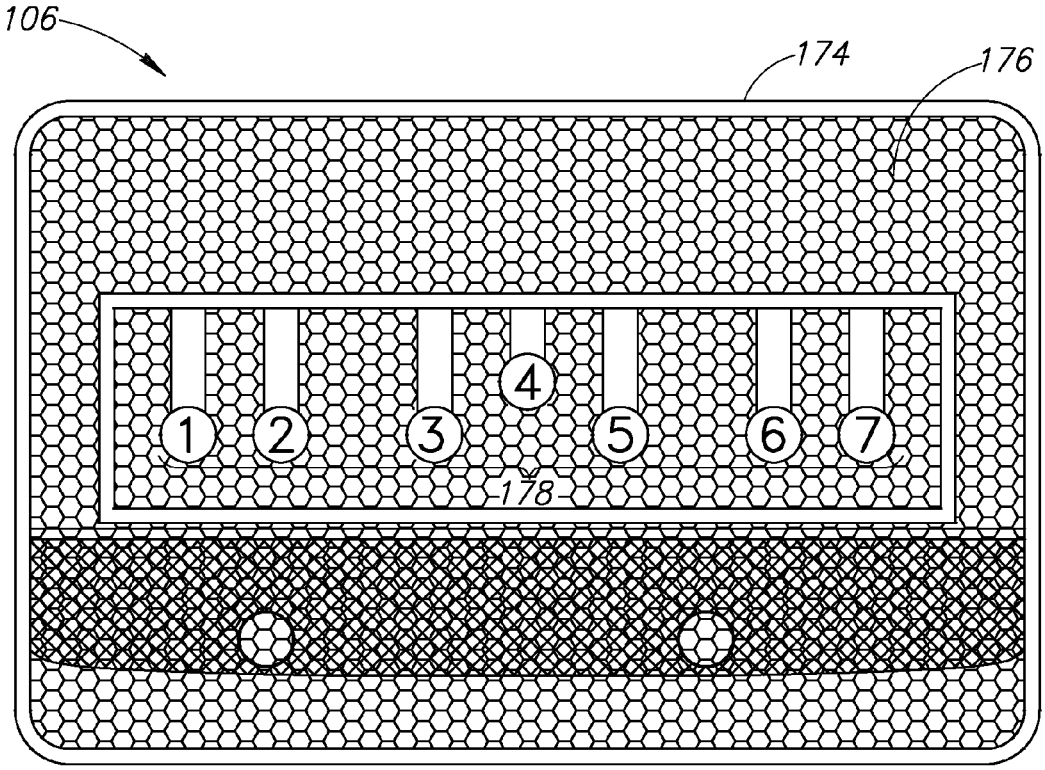
FIG. 10 is a front elevational view of the netting system of FIG. 1.

FIG. 10 shows the netting system 106 having a frame assembly 174, a netting material 176 coupled to the frame assembly 174, and a plurality of indicators 178 arranged to provide feedback information to a batter regarding a direction of the ball 168 (FIG. 9) after it has been struck with the bat (not shown). In the illustrated embodiment, the indicators 178 may take the form of numbered and/or colored targets or signs attached to the netting material 176; however other than alphanumeric symbols may be used. The indicators 178 provide an aiming point for the batter where the object is to strike the ball 168 (FIG. 9) from the batting tee 112 such that the ball 168 hits or comes sufficiently close to a desired indicator 178. For example, a right-handed batter hitting an inside pitch would aim for the first two indicators on the left side of the netting system 106. Alternatively, a right-handed batter hitting an outside pitch would aim for the last two indicators on the right side of the netting system 106. In addition to the indicators 178 being arranged in a left-to-right perspective relative to the frame assembly 174, a height of the indicators 178 may also be selected to indicate that the batter hit the ball in a level manner. The number or indicators 178 and their location relative to the frame assembly 174 may be modified depending on an objective of the batter, a coach or a parent, for example. In the illustrated embodiment, there is not any netting material located behind the indicators 178, but it is appreciated that the same or a lighter-duty netting material may be arranged behind the indicators 178 to prevent the ball from traveling too far. In one embodiment, the frame assembly 174 is made from aluminum, the netting material 176 is made from a polyethylene material, and the indicators 178 are made from a heavy duty nylon material.

Figure 12:
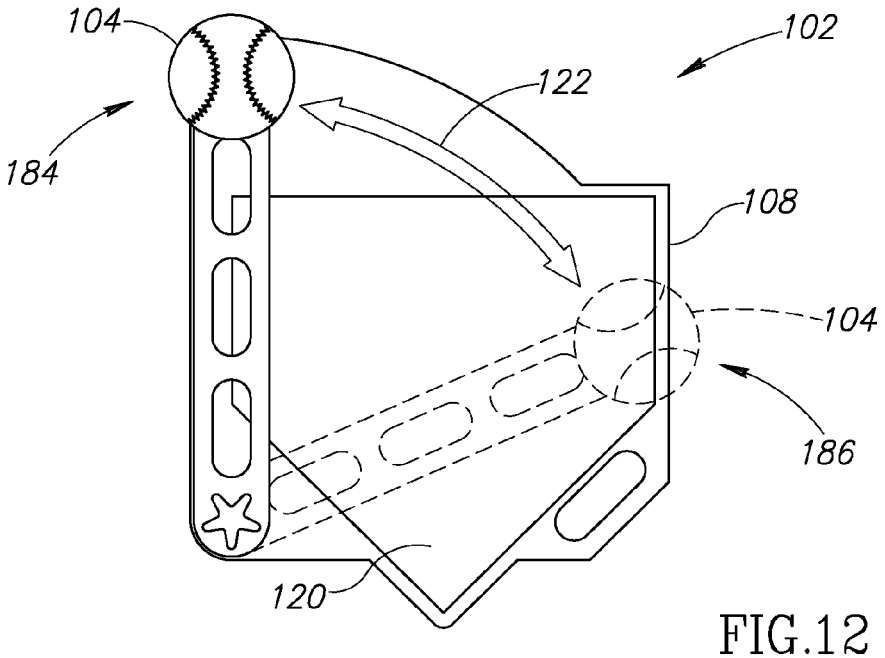
FIG. 12 is a top plan view of the batting tee assembly and ball of FIG. 1 showing other exemplary settings thereof for inside and outside simulated pitches.
Figure 13:
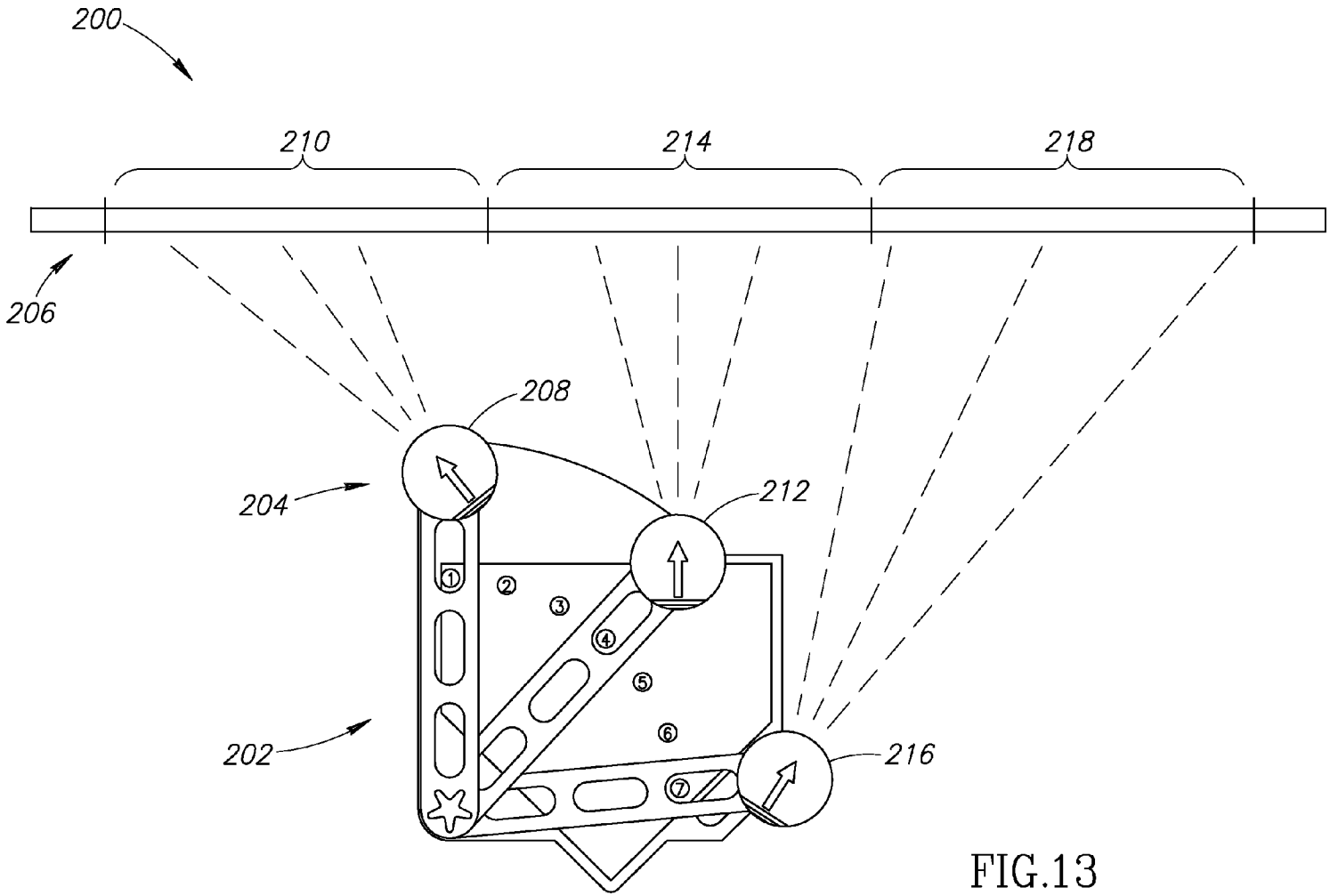
FIG. 13 is a schematic view of a batting tee system showing an overall operation thereof according to an embodiment of the present invention.

FIGS. 11-13 are provided to describe the operation of the batting tee system, and more specifically to describe how the batting tee system may be utilized to help a batter properly hit different types of pitches. FIG. 11 shows the swing arm 110 positioned to simulate a fast ball pitch where the ball 168 crosses the home plate 120 approximately in a straight line over a symmetrical centerline 180 of the home plate 120. For a left-handed batter, the swing arm 110 is secured to a far side of the support base 108 relative to the batter's stance as indicated by the footprints 182.

FIG. 12 shows the movement of the swing arm 110 along the contact path 122 with the batting tee assembly 102 set up with a ball 104 for a right-handed batter. The swing arm 110 may be rotatable relative to the support base 108 about the pivot point 123 such that the ball 104 may be positioned anywhere along the contact path 122 with incremental changes, as desired. In one embodiment, the swing arm 110 is movable through a circular, 360 degree, contact path 122. Further, the positioning of the swing arm 110 relative to the home base 120 permits the batter to learn how to hit the ball 104 at a proper time as it crosses the home base 120. By way of example, the batting tee assembly 102 teaches the right-handed batter to hit an inside pitch 184 just before the ball 104 moves across a front part of the home base 120. Similarly, the batting tee assembly 102 teaches the right-handed batter to hit an outside pitch 186 after the ball 104 has already moved across the front part of the home base 120. Thus, if the batter is not making proper contact with the ball 104, the batter will learn to adjust his or her stance relative to the home base 120. In addition, the batting tee assembly 102 may help the batter to adjust the speed and levelness of his or her bat swing.

FIG. 13 schematically illustrates a batting tee system 200 having a batting tee assembly 202, a ball 204 and a feedback system 206, where the latter may take the form of a netting system as described above. The batting tee system 200 attempts to replicate a live batting situation as it teaches and reinforces various hitting mechanics, such as, but not limited to, the batter's stance relative to home plate, arm extension for various types of pitches, recognition of various types of pitches, the bat-on-ball contact location relative to the home plate, bat speed, bat position, etc. For young batters in particular, the batting tee system 200 may be easily set up and adjusted to simulate a variety of pitches while providing immediate feedback based on the trajectory of the ball. By way of example and as shown in FIG. 13, the batting tee system 200 may help the right-handed batter learn the mechanics of how to hit an inside pitch 208 toward a left section 210 of the feedback system 206, how to hit a straight pitch 212 toward a center section 214 of the feedback system 106, and how to hit an outside pitch 216 toward a right section 218 of the feedback system.

Hitting the ball effectively is an important skill in any bat-and-ball type game. Often times, teams are formed around the so-called good hitters. The batting tee systems described herein provide a cost effective way for a batter to improve his or her hitting mechanics. In addition, the batting tee system may be assembled and set-up such that even persons who have never played a bat-and-ball sport may assist a young batter with the proper mechanics.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A batting tee system comprising:

a support base having a support base periphery, a home plate having a home plate periphery that is smaller than the support base periphery;

a ball carrying at least one target indicator;

a swing arm pivotally coupled to the support base a pivot point located outside of the home plate periphery, the swing arm movable laterally over and proximate to an upper surface of the home plate;

an adjustable-height tee coupled to the swing arm, the tee selectively positionable along a desired bat-to-ball contact path defined relative to the home plate;

wherein the swing arm includes an effective, fixed length defined as a distance from the pivot point to the adjustable-height batting tee, the fixed length determines the contact path that permits the tee to be selectively positioned at any point along the contact path by rotating only the swing arm about the pivot point to place the ball where a batter should contact the ball for achieving a desired type of pitch; and a netting system positionable at a desired distance from the tee, the netting system having a plurality of indicators arranged to provide feedback information regarding a direction of the ball after the ball is struck with a bat.

2. The batting tee system of claim 1, wherein the plurality of indicators includes sequentially arranged numbers coupled to different portions of the netting system.

3. The batting tee system of claim 1, wherein the at least one target carried by the ball takes the form of a bull's-eye target.

4. The batting tee system of claim 1, wherein the adjustable-height tee includes a concave cup portion for receiving the ball.

5. The batting tee system of claim 1, further comprising a tightening mechanism adjustable to secure the swing arm to the support base at a desired contact point.

6. The batting tee system of claim 1, wherein the batting tee system includes a handle.

7. The batting tee system of claim 1, wherein the swing arm is rotationally coupled to the adjustable-height tee, wherein the tee is movable between an upright configuration to a stowed configuration.

8. The batting tee system of claim 1, wherein the adjustable-height tee includes at least two telescoping sections.

9. The batting tee system of claim 1, wherein a top portion of the adjustable-height tee is funnel-shaped and made from a reinforced fiber composite material.

10. The batting tee system of claim 1, wherein a top portion of the adjustable-height tee is replaceable.

11. The batting tee system of claim 1, wherein a top portion of the adjustable-height tee is movable within a range of about 20 inches to about 50 inches relative to the support base.

12. The batting tee system of claim 1, wherein the home plate is painted onto the support base.

13. The batting tee system of claim 1, further comprising:

a reinforcement member coupled to a bottom surface of the support base to provide a desired amount of structural rigidity to the support base.

14. The batting tee system of claim 13, wherein the reinforcement member is molded into the support base.

15. The batting tee system of claim 1, wherein the desired bat-to-ball contact path is configured such that the adjustable-height tee is selectively positionable with respect to the home plate corresponding to a type of pitch being simulated.

16. A batting tee assembly comprising:

a support base having a support base periphery;

a home plate supported by the support base, the home plate having a home plate periphery that is smaller than the support base periphery;

a swing arm pivotally coupled to the support base at a pivot location outside of the home plate periphery, the swing arm extending laterally over and proximate to an upper surface of the home plate, the swing arm selectively positionable along an arc relative to the home plate; and an adjustable-height batting tee coupled to the swing arm, the tee movable with the swing arm to be selectively positioned in a location along the arc to simulate a type of pitch by rotating only the swing arm about the pivot point to place the ball where a batter should contact the ball for simulating the desired type of pitch.

17. The batting tee assembly of claim 16, further comprising a ball carrying at least one target indicator alignable relative to the home plate.

18. The batting tee assembly of claim 16, further comprising a netting system positionable at a desired distance from the home plate, the netting system having a plurality of indicators arranged to provide feedback information regarding a direction of the ball after the ball is struck with a bat.

19. The batting tee assembly of claim 16, wherein the adjustable-height batting tee includes at least two telescoping sections.

20. The batting tee assembly of claim 16, wherein the support base is configured to accommodate both left and right handed batters.

* * * * *